US007682016B2

(12) United States Patent
Sakuma et al.

(10) Patent No.: US 7,682,016 B2
(45) Date of Patent: Mar. 23, 2010

(54) STABLY OPERABLE IMAGE-FORMING APPARATUS WITH IMPROVED PAPER CONVEYING AND EJECTING MECHANISM

(75) Inventors: Hideomi Sakuma, Kanagawa (JP); Shinji Imoto, Tokyo (JP); Yohichi Itoh, Kanagawa (JP); Hiroshi Yasuda, Gifu (JP); Akira Ishii, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 326 days.

(21) Appl. No.: 10/536,057

(22) PCT Filed: Nov. 14, 2003

(86) PCT No.: PCT/JP03/14520

§ 371 (c)(1),
(2), (4) Date: May 24, 2005

(87) PCT Pub. No.: WO2004/048239

PCT Pub. Date: Jun. 10, 2004

(65) Prior Publication Data

US 2006/0164491 A1 Jul. 27, 2006

(30) Foreign Application Priority Data

Nov. 26, 2002 (JP) ..... 2002-341834
Nov. 26, 2002 (JP) ..... 2002-341944
Nov. 26, 2002 (JP) ..... 2002-342036
Jan. 31, 2003 (JP) ..... 2003-023221

(51) Int. Cl.
*B41J 2/01* (2006.01)

(52) U.S. Cl. ..... 347/104; 347/101; 347/4; 271/272; 271/275

(58) Field of Classification Search ..... 347/101–104, 347/4; 101/288, 483–493; 400/629; 271/272, 271/275, 7, 193, 198
See application file for complete search history.

(56) References Cited

U.S. PATENT DOCUMENTS 5,061,092 A 10/1991 Takeda et al.
5,136,307 A * 8/1992 Uchida et al. ..... 346/136
5,219,154 A 6/1993 Fukube et al.

(Continued)

FOREIGN PATENT DOCUMENTS

CN 1139221 A 1/1997

(Continued)

OTHER PUBLICATIONS

Oct. 18, 2007 European Search Report in connection with corresponding European patent application No. 03 77 2782.

(Continued)

*Primary Examiner*—Matthew Luu
*Assistant Examiner*—Henok Legesse
(74) *Attorney, Agent, or Firm*—Cooper & Dunham, LLP

(57) ABSTRACT

An image-forming apparatus includes an endless conveyor belt, a counter roller, and a clutch part. The endless conveyor belt is rotatable to convey paper with a surface of the conveyor belt being charged. The counter roller holds the paper between the conveyor belt and the counter roller and conveys the paper. The clutch part is caused to slip by the difference in velocity between the conveyor belt and the counter roller. The counter roller is driven through the clutch part.

10 Claims, 6 Drawing Sheets

U.S. PATENT DOCUMENTS

| | | | | |
|---|---|---|---|---|
| 5,225,852 | A | 7/1993 | Uchida et al. | |
| 5,248,210 | A * | 9/1993 | Schulz | 400/625 |
| 5,299,371 | A | 4/1994 | Haberstroh | |
| 5,316,282 | A | 5/1994 | Fukube et al. | |
| 5,452,063 | A * | 9/1995 | Fletcher | 399/308 |
| 5,565,975 | A * | 10/1996 | Kumon et al. | 399/302 |
| 5,732,310 | A | 3/1998 | Hiroshima et al. | |
| 5,970,866 | A * | 10/1999 | Okawa | 101/118 |
| 6,091,926 | A * | 7/2000 | Yamada | 399/329 |
| 6,173,148 | B1 | 1/2001 | Matsuda et al. | |
| 6,386,697 | B1 * | 5/2002 | Yamamoto et al. | 347/103 |
| 6,419,411 | B1 * | 7/2002 | Tanno | 400/635 |
| 6,499,841 | B1 * | 12/2002 | Uchida et al. | 347/104 |
| 6,626,098 | B1 * | 9/2003 | Kanamori | 101/128.4 |
| 6,786,590 | B2 * | 9/2004 | Maki et al. | 347/104 |
| 6,799,011 | B2 * | 9/2004 | Abe et al. | 399/299 |
| 2002/0018097 | A1 * | 2/2002 | Kitahara et al. | 347/42 |
| 2002/0021312 | A1 | 2/2002 | Matsumoto | |
| 2002/0126193 | A1 | 9/2002 | Maki et al. | |
| 2002/0186294 | A1 * | 12/2002 | Torisawa et al. | 347/228 |

FOREIGN PATENT DOCUMENTS

| | | | |
|---|---|---|---|
| CN | 1226011 | A | 8/1999 |
| EP | 0507306 | A1 | 10/1992 |
| JP | 57-106813 | | 7/1982 |
| JP | 2-182641 | | 7/1990 |
| JP | 4-251041 | | 9/1992 |
| JP | 7-53081 | | 2/1995 |
| JP | 7-53082 | | 2/1995 |
| JP | 7-61622 | | 3/1995 |
| JP | 7-311485 | | 11/1995 |
| JP | 8-295438 | | 11/1996 |
| JP | 9-222801 | | 8/1997 |
| JP | 10-161436 | | 6/1998 |
| JP | 10-193584 | | 7/1998 |
| JP | 10-203679 | | 8/1998 |
| JP | 11-38696 | | 2/1999 |
| JP | 2897960 | | 3/1999 |
| JP | 11-349182 | | 12/1999 |
| JP | 2000-177870 | | 6/2000 |
| JP | 2000-272770 | | 10/2000 |
| JP | 2001-287377 | | 10/2001 |
| JP | 2001-341908 | | 12/2001 |
| JP | 2002-103598 | | 4/2002 |
| JP | 2002-145474 | | 5/2002 |
| JP | 3402895 | | 2/2003 |

OTHER PUBLICATIONS

Nov. 28, 2007 Japanese official action in connection with Japanese patent application No. 2002-342036.

Nov. 28, 2007 Japanese official action in connection with Japanese patent application No. 2002-341834.

Dec. 18, 2007 Japanese official action in connection with Japanese patent application No. 2002-341944.

Feb. 25, 2008 Japanese official action in connection with corresponding Japanese application No. 2003-023221.

Mar. 28, 2008 European search report in connection with corresponding European patent application No. EP 03 77 2782.

Apr. 15, 2008 Japanese official action in connection with corresponding Japanese patent application No. 2002-342036.

May 9, 2008 Chinese official action in connection with corresponding Chinese application No. 2003-801039899 (and English translation thereof).

* cited by examiner

STABLY OPERABLE IMAGE-FORMING APPARATUS WITH IMPROVED PAPER CONVEYING AND EJECTING MECHANISM

TECHNICAL FIELD

The present invention relates generally to image-forming apparatuses, and more particularly to an image-forming apparatus that uses a conveyor belt to convey a sheet of paper.

BACKGROUND ART

An ink-jet printer is a well-known one of image-forming apparatuses (or image-recording apparatuses) such as printers, facsimile machines, and copiers. The ink-jet printer performs recording on a recording medium such as paper (recording paper) by ejecting ink from a recording head. The recording medium is not limited to paper. The recording medium refers to a medium on which an image is formable. The recording medium may be an OHP (overhead projector) sheet, for instance. The ink-jet printer can record a high-definition image at high speed with low running cost and reduced noise. Further, the ink-jet printer enjoys another advantage of easiness in recording a color image using multiple color inks.

A well-known ink-jet head includes, as a part for generating energy to eject ink, a piezoelectric actuator such as a piezoelectric element, a thermal actuator, a shape memory alloy actuator, or an electrostatic actuator. The thermal actuator utilizes the phase change of liquid caused by film boiling using an electrothermal transducer such as a heat element. The shape memory alloy actuator utilizes the phase change of metal caused by a change in temperature. The electrostatic actuator employs an electrostatic force.

There is an image-forming apparatus of an electrophotographic type. This type of image-forming apparatus forms a toner image on a photosensitive body using a charging unit, an exposure unit, and a developing unit provided around a photosensitive body drum, transfers the toner image to paper by a transfer unit, and fixes the toner image on the paper by a fixing unit.

Paper conveying units for such an image-forming apparatus are provided. Japanese Laid-Open Patent Application No. 7-53082 (Prior Art 1) discloses a paper conveying unit that conveys a sheet of paper fed at an angle from above directly in a horizontal direction and ejects the sheet of paper after recording. Meanwhile, Japanese Laid-Open Patent Application No. 8-295438 (Prior Art 2) discloses a paper conveying unit that changes the conveying direction of a sheet of paper fed substantially vertically from below by substantially 90 degrees using a guide member having a section with a round profile, and ejects the sheet of paper after recording.

Two types of conveyors may be used for conveying a sheet of paper. The first type of conveyor employs conveying rollers to convey a sheet of paper. Meanwhile, Prior Art 1 and Prior Art 2 disclose the second type of conveyor with an endless charged belt. The second type of conveyor causes a sheet of paper to adhere electrostatically to the charged surface of the charged belt, and rotates the charged belt with the sheet of paper adhering thereto so as to convey the sheet of paper. Thereby, this type of conveyor prevents the sheet of paper from being detached from the charged belt, thus maintaining a high flatness of the sheet of paper.

The image-forming apparatus of Prior Art 2 horizontally conveys the sheet of paper fed substantially vertically from below by changing the conveying direction of the sheet of paper by substantially 90 degrees by causing the fed sheet of paper to come into contact with a conveying guide formed along the surface of the conveyor belt (or a conveying path with a round profile).

In the case of horizontally conveying a sheet of paper fed substantially vertically in an upward direction by changing the conveying direction of the sheet of paper by substantially 90 degrees while guiding the sheet of paper by a conveying guide in a conveying path having a section with a round profile as in the image-forming apparatus of Prior Art 2, if the sheet of paper is plain paper, the resistance generated at the conveying guide is low when the sheet of paper comes into contact with the conveying guide. As a result, the sheet of paper can be conveyed with high accuracy without any problem even with a conveying belt with a low coefficient of friction $\mu$.

On the other hand, thick paper such as glossy paper for improving image quality or a card is used particularly in an ink-jet recording apparatus. If such thick paper is used, the resistance generated at the time of changing the conveying direction of the sheet of paper becomes high so that the generated resistance exceeds conveying power if a conveyor belt with a low coefficient of friction $\mu$ is employed. This results in the phenomenon that the sheet of paper slips on the conveyor belt.

Thus, if a conveyor belt with a low coefficient of friction $\mu$, which is prevented from generating large conveying power, is employed in conveying a sheet of paper that requires large conveying power, the conveyance of the sheet of paper becomes unstable so that a paper jam is more likely to occur.

According to ink-jet recording, ink adheres to paper. Therefore, when an image is formed on the paper, moisture included in the ink causes the paper to stretch. This phenomenon is referred to as cockling. Cockling causes paper waviness so that the distance between a nozzle of a recording head and a paper surface varies depending on a position on the paper surface. Cockling may worsen to such an extent that, in the worst case, the paper comes into contact with the nozzle surface of the recording head. As a result, not only the nozzle surface of the recording head but also the paper itself may be contaminated so that image quality is degraded. Further, ink droplet misdirection may be caused by the effect of cockling.

According to a conventional ink-jet recording apparatus, paper feeding is performed by rollers. A pair of rollers is provided on each side of an image printing region (where a recording head performs printing) in a paper feed direction. One of the pairs is the combination of a spur and a roller. According to this configuration, however, the accuracy of paper feeding can be guaranteed only when paper is held between each pair of rollers.

Due to a recent demand for an increase in the printing region, however, some ink-jet printing apparatuses perform printing with paper being held by only one of the two pairs of rollers, which is a state that cannot guarantee the accuracy of paper feeding, in order to secure the printing region. With paper being held by only one of the two pairs of rollers, however, the occurrence of paper flotation cannot be handled or the accuracy of paper feeding cannot be guaranteed because of insufficient conveying power. This results in the degradation of image quality.

Therefore, an ink-jet recording apparatus that includes an endless charged belt to maintain the flatness of paper has been proposed. Such an ink-jet recording apparatus causes paper to adhere electrostatically to the charged surface of the charged belt, and rotates the charged belt with the paper adhering thereto so as to convey the paper. Thereby, the ink-jet recording apparatus prevents the paper from being detached from the charged belt, thus maintaining a high flatness of the paper.

Such an ink-jet recording apparatus is disclosed in Japanese Patent No. 2897960 (Prior Art 3) and Japanese Laid-Open Patent Application No. 7-53081 (Prior Art 4).

In the case of conveying paper electrostatically adhering to a conveyor belt as in the above-described conventional ink-jet recording apparatus, the flatness of the paper is directly linked to the flatness of the conveyor belt.

In this case, the conveyor belt engages at least two rollers to extend therebetween so that a chord part of the conveyor belt opposes an image printing region. However, the conveyor belt is prone to have wrinkles in its chord part, and when the conveyor belt is rotated, the conveyor belt may undulate in its chord part. As a result, the flatness of the conveyor belt may decrease.

Thus, even in the case of employing a conveyor belt, a decrease in the flatness of the conveyor belt causes a variation in the distance between a recording head and paper, thus degrading image quality.

Further, in the case of conveying paper electrostatically adhering to a conveyor belt as in the above-described conventional ink-jet recording apparatus, in order to stack the paper in a paper ejection part, the paper is separated from the conveyor belt by self stripping. Inelastic paper or paper that has lost elasticity with a solid image formed thereon, however, is prevented from being separated from the conveyor belt by self stripping, and remains adhered to the conveyor belt. As a result, a paper jam occurs.

Furthermore, in the case of conveying paper electrostatically adhering to a conveyor belt as in the above-described conventional ink-jet recording apparatus, it is necessary to secure an electrostatic adhesive force by the conveyor belt to cause the paper to adhere to the conveyor belt. In the conventional image-forming apparatus, however, the conveyor belt is a single-layer belt so that a sufficient electrostatic adhesive force to convey the paper stably cannot be obtained.

SUMMARY

In an aspect of this disclosure, an image-forming apparatus is provided that can stably convey paper that requires a large conveying power by changing the conveying direction of the paper.

In another aspect of this disclosure, an image-forming apparatus is provided that can maintain the flatness of a conveyor belt and perform recording with high image quality.

In another aspect of this disclosure, an image-forming apparatus is provided that can ensure the separation of paper from a conveyor belt.

In another aspect of this disclosure, an image-forming apparatus is provided that can stably convey paper using a conveyor belt.

In an exemplary embodiment of this disclosure, an image-forming apparatus includes an endless conveyor belt rotatable to convey paper with a surface of the conveyor belt being charged, a counter roller for holding the paper between the conveyor belt and the counter roller and conveying the paper, and a clutch part that is caused to slip by a difference in velocity between the conveyor belt and the counter roller, wherein the counter roller is driven through the clutch part.

In another exemplary embodiment of this disclosure, an image-forming apparatus includes a conveying roller rotatable to convey paper, a counter roller for holding the paper between the conveying roller and the counter roller and conveying the paper, and a clutch part that is caused to slip by a difference in velocity between the conveying roller and the counter roller, wherein the counter roller is driven through the clutch part.

According to the above-described image-forming apparatuses, the counter roller for holding the paper between the conveyor belt or the conveying roller and the counter roller and conveying the fed paper is driven through the clutch part caused to slip by the difference in velocity between the counter roller and the conveyor belt or the conveying roller. Accordingly, even paper requiring a large conveying power is stably conveyable, with its conveying direction being changed, without incurring frictional electrification that affects conveyability and images and an increase in load due to friction.

In another exemplary embodiment of this disclosure, an image-forming apparatus includes an endless conveyor belt rotatable to convey paper with a surface of the conveyor belt being charged, the conveyor belt being supported by at least two rollers, and engaging the two rollers so as to extend therebetween, a recording head ejecting a liquid droplet to record an image on the paper in a printing region, and a guide member provided on an inner side of the conveyor belt in a position corresponding to the printing region with a surface of the guide member projecting toward the recording head beyond a tangent of the rollers supporting the conveyor belt, the surface of the guide member coming into contact with the conveyor belt.

According to the above-described image-forming apparatus, the chord part of the conveyor belt which part corresponds to the printing region can be prevented from including waviness or a variation in movement. As a result, it is possible to record an image with high quality.

In another exemplary embodiment of this disclosure, an image-forming apparatus includes an endless conveyor belt rotatable to convey paper with a surface of the conveyor belt being charged and the paper adhering to the surface, the conveyor belt being supported by at least two rollers, and engaging the two rollers so as to extend therebetween, a recording head ejecting a liquid droplet to record an image on the paper, and a separation mechanism that separates the paper from the conveyor belt on a side of the conveyor belt on which side the paper on which the image is recorded is ejected from the image-forming apparatus.

According to the above-described image-forming apparatus, the separation mechanism is provided on the paper ejection side of the conveyor belt. Accordingly, it is ensured that the paper is separated from the conveyor belt and ejected, thus preventing the occurrence of a paper jam.

In another exemplary embodiment of this disclosure, an image-forming apparatus includes an endless conveyor belt rotatable to convey paper with a surface of the conveyor belt being charged and the paper adhering to the surface, the conveyor belt being supported by at least two rollers, and engaging the two rollers so as to extend therebetween, and a recording head ejecting a liquid droplet to record an image on the paper, the paper being ejected from the image-forming apparatus after the image is recorded on the paper, wherein the conveyor belt includes a double-layer structure including an insulating layer and a medium resistance layer.

According to the above-described image-forming apparatus, the conveyor belt is formed of a double-layer structure including a top (outer) layer, which is the insulating layer, and a bottom (inner) layer, which is the medium resistance layer. Accordingly, a sufficient electrostatic adhesive force can be obtained so that the paper can be conveyed stably and thus image quality can be improved.

BRIEF DESCRIPTION OF THE DRAWINGS

Other objects, features and advantages of the present invention will become more apparent from the following detailed description when read in conjunction with the accompanying drawings, in which.

BEST MODE FOR CARRYING OUT THE INVENTION

A description is given below, with reference to the accompanying drawings, of embodiments of the present invention.

First Embodiment

A description is given of a first embodiment of the present invention.

Figure 1:
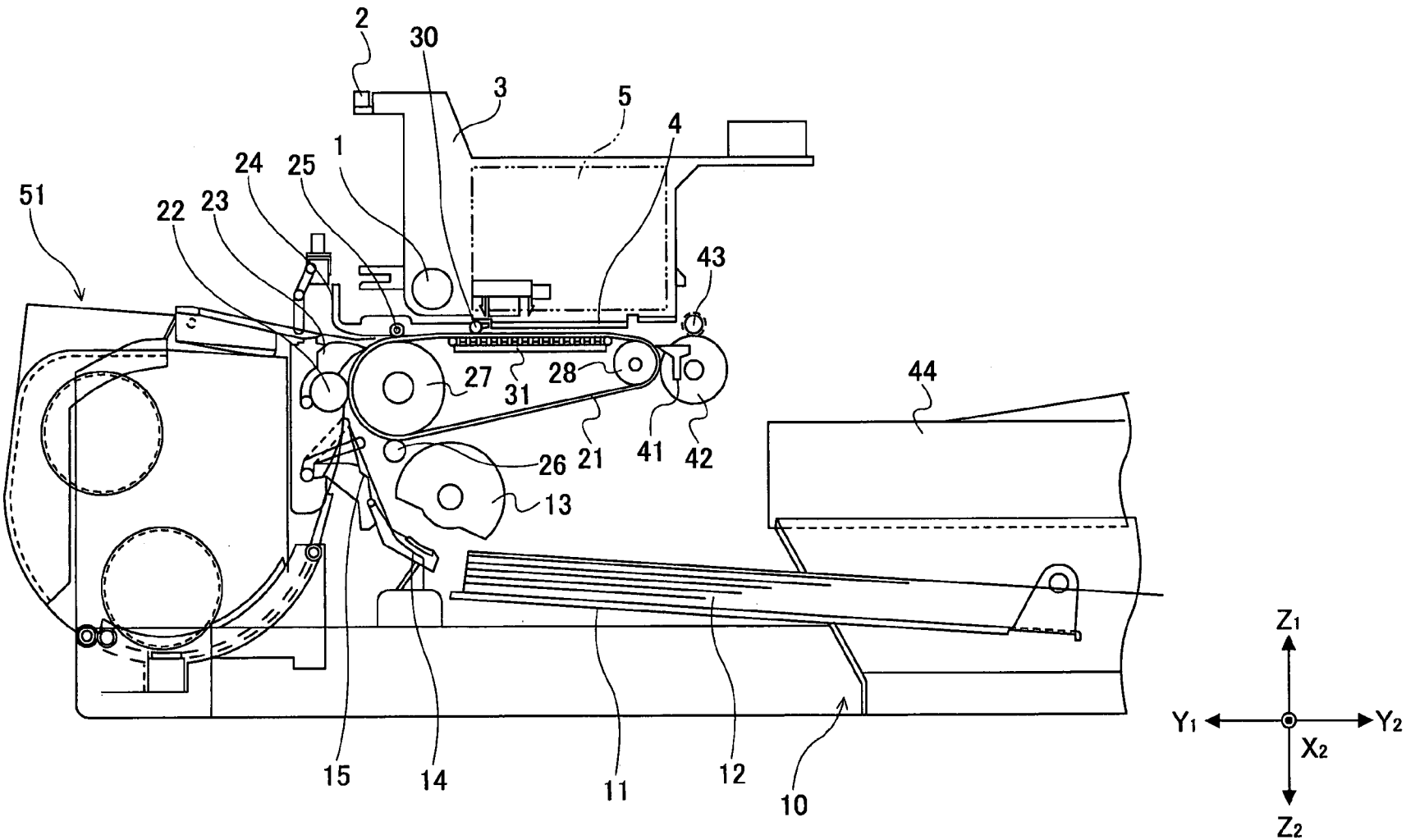
FIG. 1 is a diagram showing a configuration of an ink-jet recording apparatus as an image-forming apparatus according to a first embodiment of the present invention.
Figure 2:
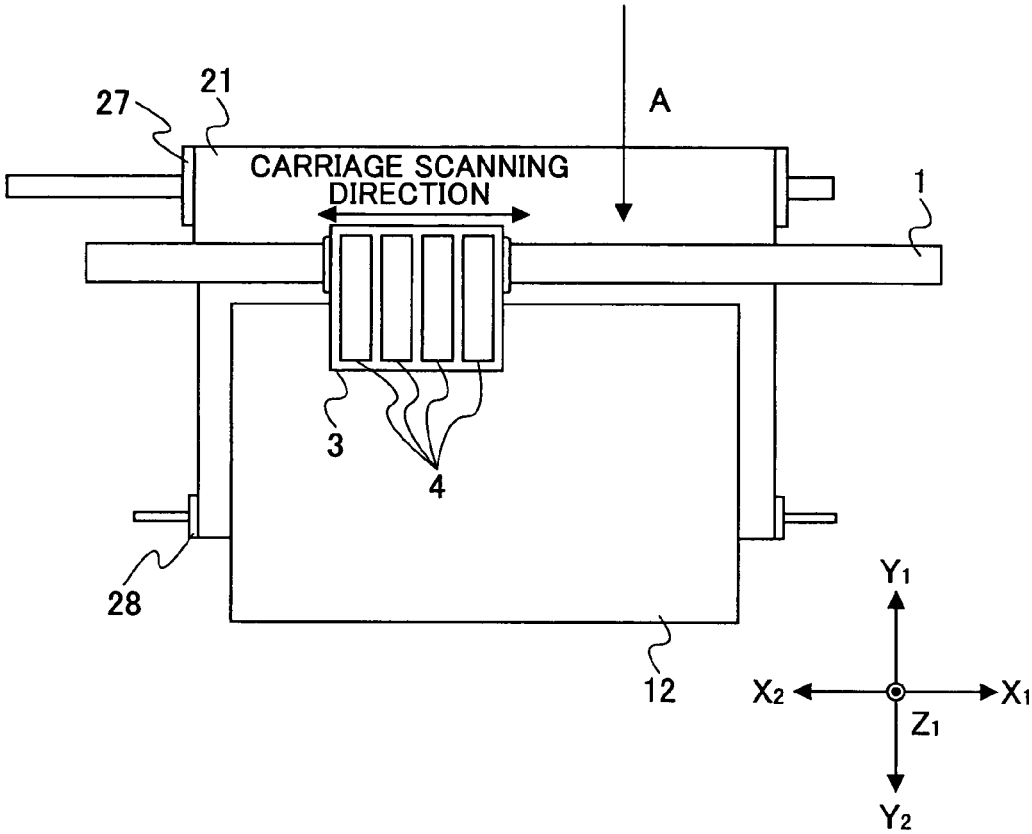
FIG. 2 is a plan view of part of the ink-jet recording apparatus according to the first embodiment of the present invention.
Figure 3:
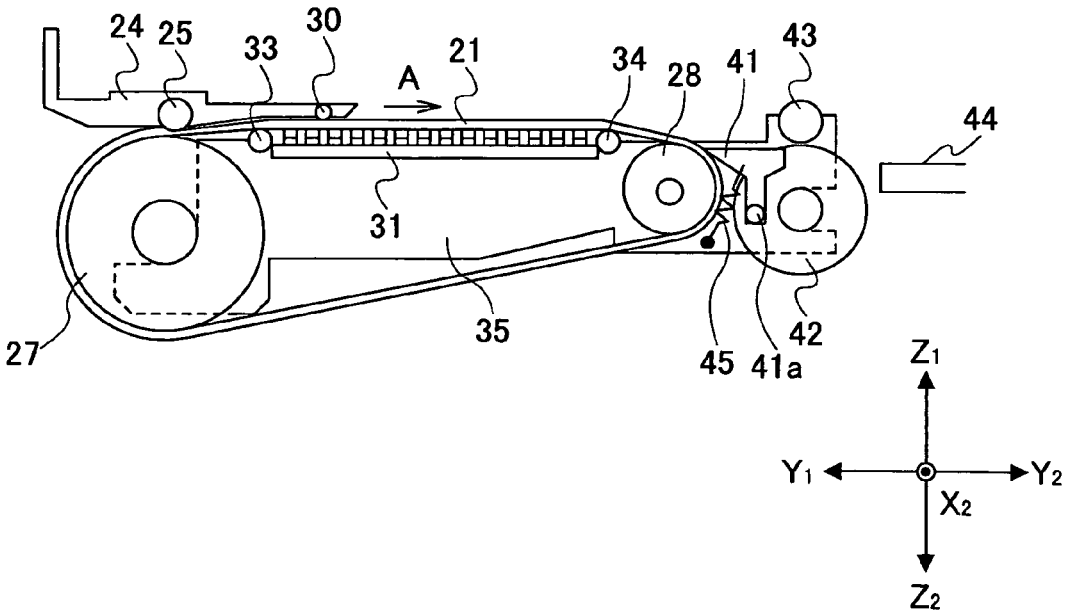
FIG. 3 is a diagram showing part of a conveying part of the ink-jet recording apparatus according to the first embodiment of the present invention.

FIG. 1 is a diagram showing a configuration of an ink-jet recording apparatus as an image-forming apparatus according to the first embodiment of the present invention. FIG. 2 is a plan view of part of the ink-jet recording apparatus. FIG. 3 is a diagram showing part of a conveying part of the ink-jet recording apparatus.

Referring to FIGS. 1 and 2, the ink-jet recording apparatus of the present invention includes a guide rod 1 and a stay 2 provided as guide members extending between side plates (not shown in the drawings) on the $X_1$ and $X_2$ sides. The ink-jet recording apparatus holds a carriage 3 by the guide rod 1 and the stay 2 so that the carriage 3 is slidable in a main scanning direction or the $X_1$ and $X_2$ directions. A main scanning motor (not shown in the drawings) drives the carriage 3 so that the carriage 3 moves and scans in the $X_1$ and $X_2$ directions.

The carriage 3 includes a recording head 4 composed of four ink-jet heads of yellow (Y), cyan (C), magenta (M), and black (Bk) ejecting ink droplets of respective colors. The recording head 4 is attached so that the ink ejection openings of the recording head 4 are arranged in a direction to cross the main scanning direction and ink is ejected from the ink ejection openings in the $Z_2$ (downward) direction.

Each ink-jet head composing the recording head 4 may employ a piezoelectric actuator such as a piezoelectric element, a thermal actuator, a shape memory alloy actuator, or an electrostatic actuator as a part for generating energy to eject ink.

The carriage 3 includes sub tanks 5 of the four colors for supplying the respective color inks to the recording head 4. The color inks are supplied from respective main tanks (ink cartridges) through ink supply tubes (not shown in the drawings) to the corresponding sub tanks 5.

Further, the ink-jet recording apparatus includes a paper feed part for feeding sheets of paper 12 stacked on a paper stacking part (a pressure plate) 11 of a paper feed cassette 10. The paper feed part includes a crescent-shaped roller (a paper feed roller) 13 that separates and feeds the sheets of paper 12 one by one from the paper stacking part 11 and a separation pad 14 formed of a material with a high coefficient of friction and provided to oppose the paper feed roller 13. The separation pad 14 is biased toward the paper feed roller 13.

The ink-jet recording apparatus includes a conveying part for conveying each sheet of paper 12 fed from the paper feed part below (on the $Z_2$ side of) the recording head 4. The conveying part includes a conveyor belt 21, a counter roller (a pressure roller) 22, a conveying guide 23, an edge pressure roller 25, and a charging roller 26. The conveyor belt 21 conveys the sheet of paper 12 by causing the sheet of paper 12 to adhere electrostatically to the conveyor belt 21. A sheet of paper 12 is fed through a guide 15 from the paper feed part to be conveyed and held between the conveyor belt 21 and the counter roller 22. The conveying guide 23 changes the conveying direction of the sheet of paper 12 fed substantially vertically in the upward ($Z_1$) direction by substantially 90 degrees so that the sheet of paper 12 is conveyed on and along the conveyor belt 21. The edge pressure roller 25 is biased toward the conveyor belt 21 by a holding member 24. The charging roller 26 is a charging part that charges the surface of the conveyor belt 21. A holding roller 30 is provided to the $Y_2$ end of the holding member 24. The holding roller 30 may be omitted from the ink-jet recording apparatus.

Referring to FIGS. 1 and 3, the conveyor belt 21 is an endless belt (a belt with no ends or a belt whose both ends are connected), and engages a conveying roller 27 and a tension roller 28 provided with tension so as to extend therebetween. The conveyor belt 21 rotates in the direction indicated by arrow A in FIG. 3. This direction may be referred to as a belt or paper conveying direction.

Figure 4:
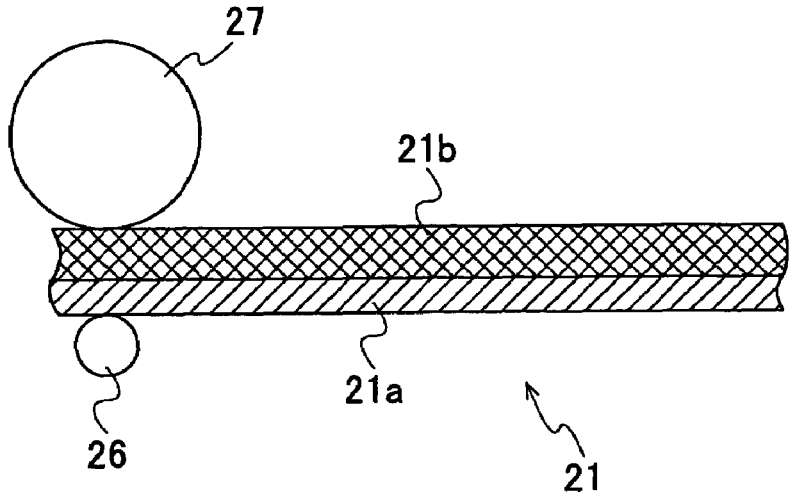
FIG. 4 is a diagram for illustrating a structure of a conveyor belt of the ink-jet recording apparatus according to the first embodiment of the present invention.

Referring to FIG. 4, the conveyor belt 21 includes a top (outer) layer 21*a* and a bottom (inner) layer 21*b*. The top layer 21*a* serves as a paper adhesion surface to which a sheet of paper 12 may adhere. The top layer 21*a* is formed of an approximately 40 μm-thick pure resin material, for instance, a pure ETFE (Ethylene Tetra Fluoro Ethylene) material, with no resistance control. The bottom layer 21*b* is formed of the same material as the top layer 21*a*, to which resistance control by carbon is provided. The bottom layer 21*b* may also be referred to as a medium resistance layer or a ground layer.

The thickness of the insulating layer (top layer) 21*a* of the conveyor belt 21 affects a dielectric constant. If the thickness becomes greater, the dielectric constant becomes lower so that the amount of electric charge on the conveyor belt 21 at the time of the charging of the conveyor belt 21 decreases. Accordingly, the electrostatic adhesive force can be increased by making the top layer 21*a* as thin as possible within a range where the thickness of the top layer 21*a* is prevented from becoming zero even if the conveyor belt 21 is damaged by actual use. Further, the range of variation of the layer thickness, which may vary for manufacturing reasons, should also be considered in making the top layer 21*a* as thin as possible. According to experiments, a desired electrostatic adhesive force was obtained with the thickness of the top layer 21*a* being less than or equal to 60 μm.

The thickness of the bottom layer 21*b* of the conveyor belt 21 does not directly affect the electrostatic action. If the total thickness of the conveyor belt 21 increases, however, its rigidity increases so that it becomes difficult to secure the flatness of the conveyor belt 21 when the conveyor belt 21 is mounted (tightened) in an actual apparatus. On the other hand, the thickness of the conveyor belt 21 cannot be overly reduced in order to secure required strength. According to experiments, it is desired that the bottom layer 21*b* be approximately 40 to 200 μm in thickness, and more preferably, approximately 50 to 200 μm in thickness.

Thus, the conveyor belt 21 is formed to have a double-layer structure with the layer 21*b* with resistance control being formed on the bottom (inner) surface of the conveyor belt 21. This structure makes it possible to previously form an electric charge on the top layer 21*a*, which is an insulating layer, and thereafter supply an additional electric charge to the top layer 21*a* when the sheet of paper 12 that is to adhere to the conveyor belt 21 comes into contact therewith, thereby increasing the electrostatic adhesive force between the sheet of paper 12 and the conveyor belt 21. If the conveyor belt 12 is formed of only a single insulating layer, the adhesive force is reduced by half compared with the above-described case of the double-layer structure. Further, in the case of the single-layer structure, the sheet of paper 12 should start to come into contact with the conveyor belt 21 at a position opposite a ground roller provided inside the conveyor belt 21. No such restriction is imposed in the case of the double-layer structure.

In this case, a desired electrostatic adhesive force was obtained using a material with a surface resistivity of 1E+10 Ω/sq. or more as the top layer 21*a* and a material with a surface resistivity of 1E+08 Ω/sq. or less as the bottom layer 21*b*.

The charging roller 26 is disposed so as to come into contact with the top layer 21*a* of the conveyor belt 21 and rotate, driven by the rotation of the conveyor belt 21. A force of 2.5 N is applied to each end of the shaft of the charging roller 26 as pressure. The conveying roller 27, which also serves as the above-described ground roller, is disposed in contact with the medium resistance layer (bottom layer) 21*b* of the conveyor belt 21 to be grounded. The conveying roller 27 may have a volume resistivity of 1E+10 Ω·cm or less so as to also serve as a ground roller.

Figure 5:
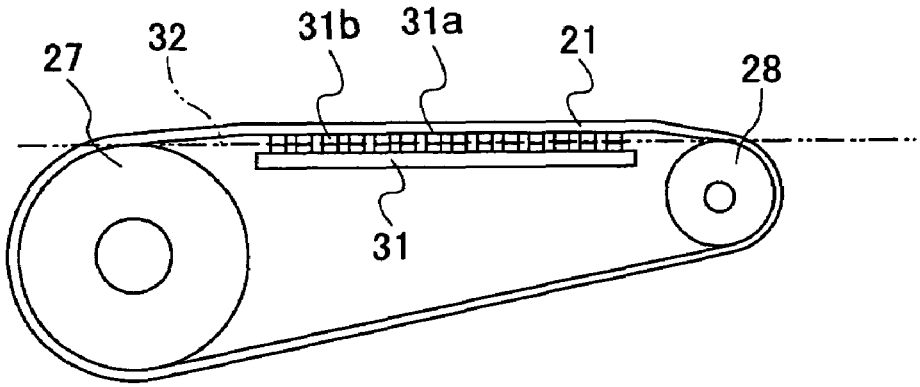
FIG. 5 is a diagram for illustrating an arrangement of a guide member of the ink-jet recording apparatus according to the first embodiment of the present invention.
Figure 6:
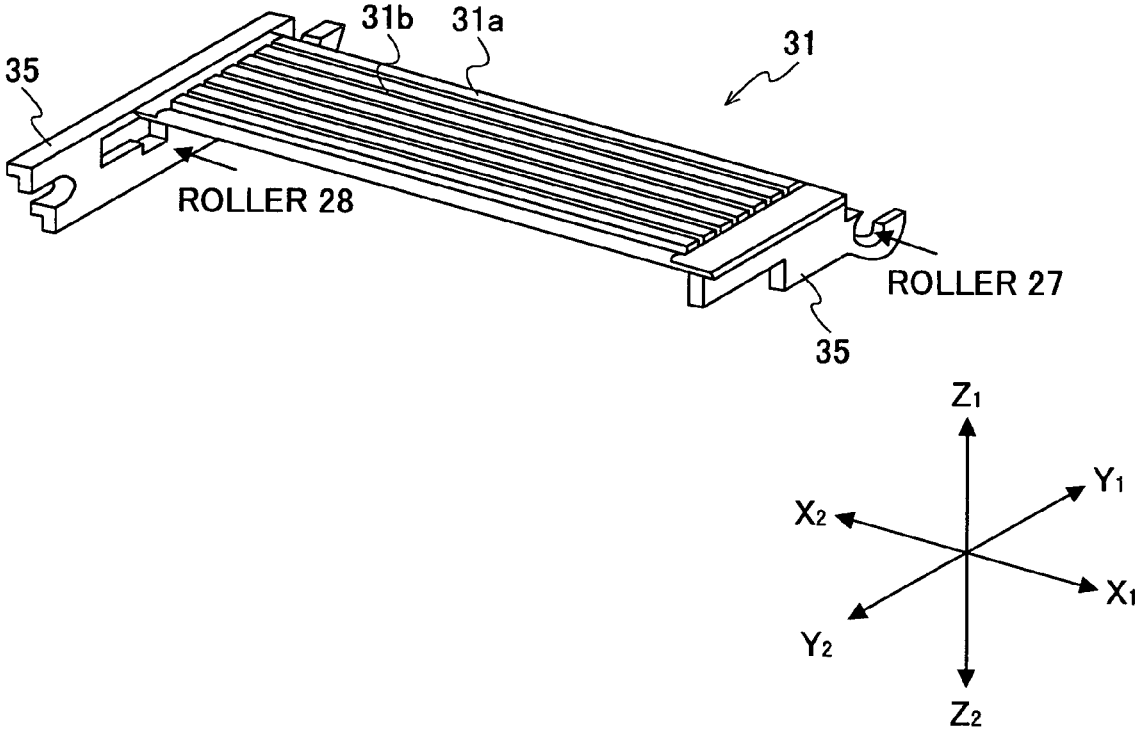
FIG. 6 is a perspective view of the guide member according to the first embodiment of the present invention.

Referring to FIGS. 3 and 5, on the bottom-layer (inner) side of the conveyor belt 21, a guide member 31 is provided at a position corresponding to a printing region where the recording head 4 performs printing. Referring to FIGS. 3 and 6, the $X_1$ and $X_2$ ends of the guide member 31 are supported by frame members 35 holding the conveying roller 27 and the tension roller 28 so that the guide member 31 is held between the frame members 35.

Referring to FIG. 5, an upper ($Z_1$-side) surface 31*a* of the guide member 31 projects toward the recording head 4 beyond a tangent 32 of the conveying roller 27 and the tension roller 28 supporting the conveyor belt 21. According to this configuration, in the printing region, the conveyor belt 21 is guided, being pushed up by the upper surface of the guide member 31, so as to maintain high flatness.

Thus, the guide member 31 provided on the bottom-layer side of the conveyor belt 21 pushes up the chord part of the conveyor belt 21 which part corresponds to the printing region toward the recording head 4 side so that the conveyor belt 21 moves along the guide member 31. This prevents the occurrence of wrinkles or waviness in the chord part of the conveyor belt 21. As a result, the flatness of the conveyor belt 21 can be kept high, so that recording can be performed with high image quality.

Further, referring to FIG. 6, on the surface 31*a* of the guide member 31, which surface 31*a* comes into contact with the bottom (inner) surface of the conveyor belt 21, a plurality of grooves 31*b* are formed in a direction perpendicular to the belt conveying direction in order to reduce the area of contact with the conveyor belt 21. As a result, the conveyor belt 21 can move smoothly on and along the surface of the guide member 31.

Further, referring to FIG. 3, a guide roller 33 and a guide roller 34 are rotatably provided in contact with the bottom surface of the conveyor belt 21 on the upstream side and the downstream side, respectively, of the guide member 31 in the belt conveying direction. It is preferable that the guide rollers 33 and 34 be disposed close to the $Y_1$ and $Y_2$ ends, respectively, of the guide member 31 in the belt conveying direction.

Thus, the guide rollers 33 and 34 are rotatably provided in contact with the bottom surface of the conveyor belt 21 on the upstream side and the downstream side, respectively, of the guide member 31 in the belt conveying direction. As a result, the friction generated between the conveyor belt 21 and the $Y_1$ and $Y_2$ ends of the guide member 31 can be reduced. Accordingly, a driving load by the conveyor belt 21 can be decreased, and a variation in the movement of the conveyor belt 21 due to the rubbing of the conveyor belt 21 against the ends of the guide member 31 can also be avoided. Accordingly, it is possible to prevent wrinkles or waviness from occurring in the chord part of the conveyor belt 21 with more certainty. As a result, the flatness of the conveyor belt 21 can be kept high, so that recording can be performed with high image quality.

The ink-jet recording apparatus includes a paper ejection part for ejecting each sheet of paper 12 on which the recording head 4 has performed recording. Referring to FIGS. 1 and 3, the paper ejection part includes a separation claw 41 serving as a separation mechanism for separating the sheet of paper 12 from the conveyor belt 21, paper ejection rollers 42 and 43, and a paper ejection tray 44 for stocking the ejected sheet of paper 12. The separation claw 41 is provided in contact with the conveyor belt 21. The paper ejection rollers 42 and 43 are provided on the downstream side of the separation claw 41 in the belt or paper conveying direction. The paper ejection tray 44 is provided on the downstream side of the paper ejection rollers 42 and 43. The separation claw 41 is supported by a support shaft 41*a* so as to be pivotable. An elastic body 45 such as a spring applies tension to the separation claw 41 toward the conveyor belt 21 so that the separation claw 41 remains in contact with the surface of the conveyor belt 21.

A duplex paper feed unit (a duplex printing mechanism) 51 for duplex printing (printing on both sides of the sheet of paper 12) is attached to the main body of the ink-jet recording apparatus (on the rear or $Y_1$ side) so as to be detachable therefrom and attachable thereto. The duplex paper feed unit 51 receives (captures) the sheet of paper 12 conveyed in the direction opposite to the belt conveying direction (in the $Y_1$ direction in FIG. 1) by the reverse rotation of the conveying belt 21. Then, the duplex paper feed unit 51 turns the received sheet of paper 12 upside down, and again feeds the turned sheet of paper 12 to the space between the counter roller 22 and the conveyor belt 21.

Figure 7:
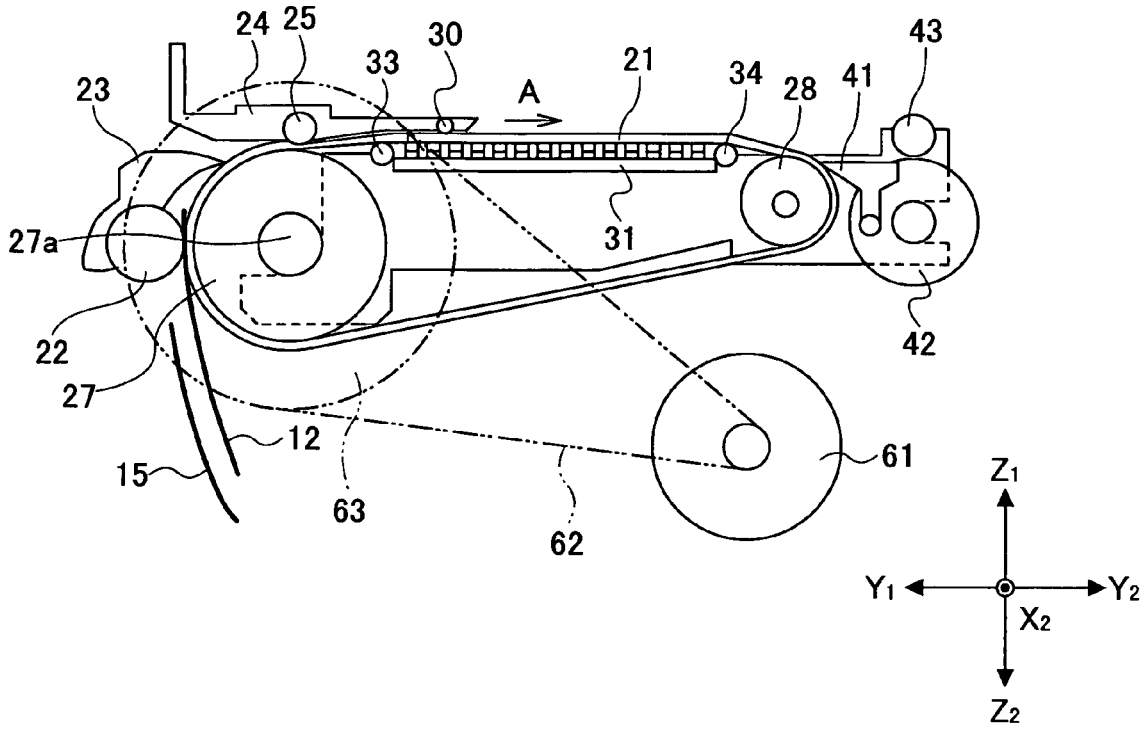
FIG. 7 is a diagram for illustrating a drive system of a counter roller of the ink-jet recording apparatus according to the first embodiment of the present invention.
Figure 8:
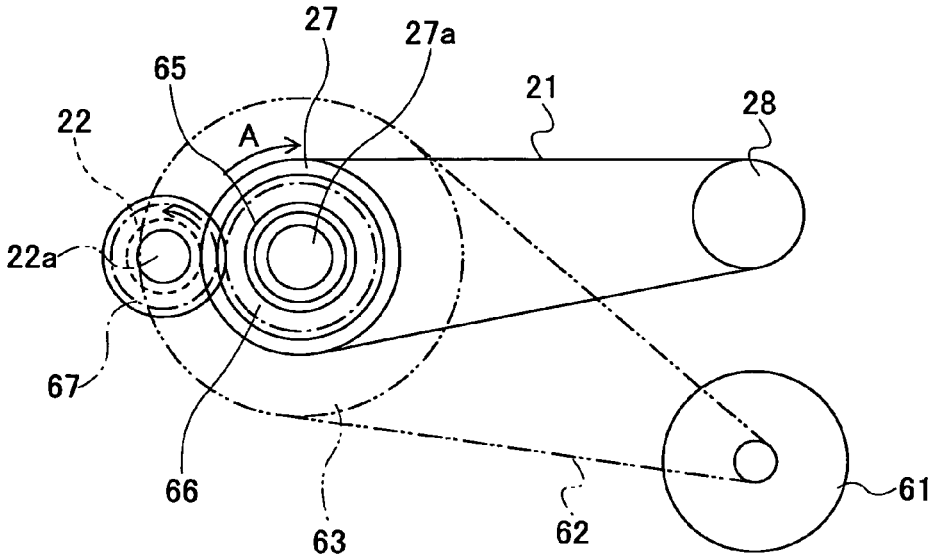
FIG. 8 is another diagram for illustrating the drive system of the counter roller of the ink-jet recording apparatus according to the first embodiment of the present invention.

A description is given, with reference to FIGS. 7 and 8, of the drive system of the counter roller 22.

According to the drive system of the counter roller 22, the conveyor belt 21 is rotated by a sub scanning motor 61 rotating the conveying roller 27 through a timing belt 62 and a timing gear 63 attached to a shaft 27*a* of the conveying roller 27.

Referring to FIG. 8, an intermediate gear 66 including a one-way clutch 65 is attached to the shaft 27*a* of the conveying roller 27. The one-way clutch 65 is a clutch part that is caused to slip by the difference in velocity between the conveying roller 27 and the counter roller 22. The intermediate gear 66 engages a driving gear 67 attached to a shaft 22*a* of the counter roller 22. As a result, a rotational driving force is transmitted from the sub scanning motor 61 through the shaft 27*a* of the conveying roller 27, the one-way clutch 65, the intermediate gear 66, and the driving gear 67 to the counter roller 22.

In this case, the one-way clutch 65 transmits the rotation of the shaft 27*a* to the intermediate gear 66 when the conveying roller 27 rotates in the direction indicated by arrow A in FIGS. 7 and 8 (also referred to as a forward conveying direction). The one-way clutch 65 does not transmit the rotation of the shaft 27*a* to the intermediate gear 66 when the conveying roller 27 rotates in the direction opposite to the forward conveying direction (or in the direction in which the sheet of paper 12 is fed into the duplex paper feed unit 51 for duplex printing).

According to the drive system of the counter roller 22, the linear velocity of the counter roller 22 is set to be lower than the linear velocity of the conveyor belt 21. The velocity ratio is set so that the linear velocity of the counter roller 22 is lower than the linear velocity of the conveyor belt 21 by approximately 2%. The experimental results showed that this velocity ratio was the most effective in this ink-jet recording apparatus.

According to the ink-jet recording apparatus having the above-described configuration, sheets of paper 12 are separated and fed one by one from the paper feed part, and each sheet of paper 12 is fed substantially vertically in the upward direction and is guided by the guide 15 to be conveyed and held between the conveyor belt 21 and the counter roller 22, both of which are rotated, as shown in FIG. 7. Then, the fed sheet of paper 12 has its leading edge guided by the conveying guide 23 and pressed against the conveyor belt 21 by the edge pressure roller 25. Thereby, the conveying direction of the sheet of paper 12 is changed by approximately 90 degrees.

At this point, both the conveyor belt 21 and the counter roller 22 are rotated by the rotational driving force received from the sub scanning motor 61. Accordingly, even when the sheet of paper 12 is elastic paper such as glossy paper or thick paper so as to have a high coefficient of friction against the conveying guide 23 and a low coefficient of friction μ against the conveyor belt 21, the sheet of paper 12 can be fed without a slip and the conveying direction thereof can be changed so that the sheet of paper 12 can be conveyed on the conveyor belt 21.

In this case, if only the counter roller 22 is driven, a difference in velocity may occur between the counter roller 22 and the conveyor belt 21 due to factors such as a variation in the diameter, expansion due to temperature, and wear of the counter roller 22. Such a difference in velocity causes frictional electrification of the sheet of paper 12, an increase in load, and a difference in load torque between apparatuses.

The ink-jet recording apparatus according to the first embodiment of the present invention drives the counter roller 22 through the one-way clutch 65. Accordingly, when the linear velocity of the conveyor belt 21 is higher than that of the counter roller 22, it is possible to cause the counter roller 22 to slip (or to rotate following the rotation of the conveyor belt 21).

According to the first embodiment of the present invention, since the linear velocity of the counter roller 22 is set to be lower than that of the conveyor belt 21 (by approximately 2% as previously described), the one-way clutch 65 of the drive system of the counter roller 22 is caused to slip by the difference in velocity. As a result, a minute variation in the linear velocity is absorbed so as to make the conveyor belt 21 and the counter roller 22 substantially equal in velocity. This makes it possible to reduce frictional electrification of the sheet of paper 12, to reduce load, and to reduce the difference in load torque between apparatuses.

On the other hand, if the linear velocity of the conveyor belt 21 is set to be lower than that of the counter roller 22, a load on the drive system of the conveyor belt 21 increases to cause a difference in load torque between apparatuses.

In the case of duplex printing, the conveyor belt 21 is rotated in the direction opposite to the direction indicated by arrow A in FIG. 8. At this time, the one-way clutch 65 prevents a driving force from being transmitted to the counter roller 22 so that the counter roller 22 rotates following the rotation of the conveyor belt 21. After the feeding of the sheet of paper 12 into the duplex paper feed unit 51 is completed, the conveyor belt 21 rotates again in the direction of arrow A in FIG. 8 and operates in the same way as described above with respect to the sheet of paper 12 fed from the duplex paper feed unit 51.

Thus, the sheet of paper 12 is fed on the conveyor belt 21 as previously described. At this time, a control circuit (not graphically represented) causes a high-voltage power supply to alternately apply a positive output and a negative output, or repeat application of alternate voltages, to the charging roller 26. Accordingly, a pattern of the alternate charging voltages is formed on the conveyor belt 21. That is, the conveyor belt 21 is alternately charged positively and negatively at predetermined intervals in the sub scanning direction in which the conveyor belt 21 rotates so that positively and negatively charged strip-shaped areas are successively formed. When the sheet of paper 12 is fed on the conveyor belt alternately charged positively and negatively, polarization to electric charges opposite to the charging pattern of the conveyor belt 21 occurs in the sheet of paper 12. This is equivalent to the formation of capacitors connected in parallel. As a result, the sheet of paper 12 adheres to the conveyor belt 21 so that the conveyor belt 21 rotates to convey the sheet of paper 12 in the sub scanning direction.

Then, by driving the recording head 4 in accordance with an image signal while moving the carriage 3, ink droplets are ejected on the sheet of paper 12 in a stationary state so as to perform recording for a line. After conveying the sheet of paper 12 a predetermined distance, recording is performed for the next line. When a recording end signal or a signal indicating that the trailing edge of the sheet of paper 12 has reached the recording region is received, the recording operation ends and the sheet of paper 12 is ejected onto the paper ejection tray 44.

At this point, the paper ejection side ($Y_2$ side) of the conveyor belt 21 faces the separation claw 41 so as to ensure the separation and ejection of the sheet of paper 12 from the conveyor belt 21 while the electrostatic adhesive force is increased by the above-described double-layer structure of the conveyor belt 21. As a result, the sheet of paper is prevented from adhering to and thus being further conveyed by the conveyor belt 21, thus avoiding a paper jam.

The counter roller 22 and its drive system according to the present invention are also applicable to an ink-jet recording apparatus that conveys a sheet of paper only with a conveying roller without using a conveyor belt.

Second Embodiment

Next, a description is given of a second embodiment of the present invention. The same elements as those of the first embodiment are referred to by the same numerals.

Figure 9:
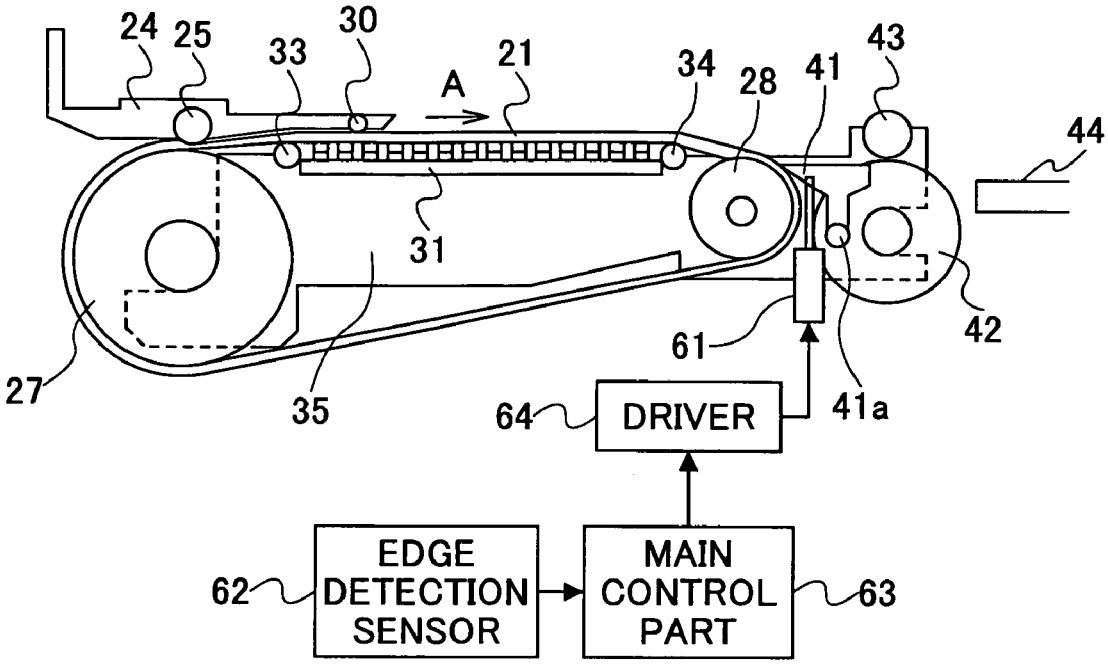
FIG. 9 is a diagram for illustrating a second embodiment of the present invention.

Referring to FIG. 9, the separation claw 41 is supported pivotably by the support shaft 41*a* so as to be contactable with (be able to come into contact with) and separable from the surface of the conveyor belt 21. In the second embodiment, a plunger 61 for causing the separation claw 41 to come into contact with and separate from the surface of the conveyor belt 21 is provided instead of the elastic body 45. A main control part 63 drives and controls the plunger 61 through a driver 64 based on a detection signal supplied from an edge detection sensor 62 detecting the edge (leading edge) of the sheet of paper 12. The edge detection sensor 62 is provided to the carriage 3.

According to this configuration, the plunger 61 may be driven to cause the separation claw 41 to come into contact with the surface of the conveyor belt 21 so as to separate the sheet of paper 12 therefrom at the time of performing recording on and ejecting the sheet of paper 12 (that is, for a period of time required for the leading edge of the sheet of paper 12 to reach the paper ejection part after being detected by the edge detection sensor 62). After the sheet of paper 12 is separated from the conveyor belt 21, it is possible to end the driving of the plunger 61 to separate the separation claw 41 from the surface of the conveyor belt 21.

According to this configuration, it is possible to cause the separation claw 41 to come into contact with the surface of the conveyor belt 21 only when required. Accordingly, the durability of the conveyor belt 21 is improved.

According to the present invention, the ink-jet recording apparatus (image-forming apparatus) includes the counter roller 22 for holding the sheet of paper 12 between the conveyor belt 21 or the conveying roller 27 and the counter roller 22 and conveying the fed sheet of paper 12. The counter roller 22 is driven through the one-way clutch (clutch part) 65 caused to slip by the difference in velocity between the counter roller 22 and the conveyor belt 21 or the conveying roller 27. Accordingly, even paper requiring a large conveying power is stably conveyable, with its conveying direction being changed, without incurring frictional electrification that affects conveyability and images and an increase in load due to friction.

Further, the conveyor belt 21 for conveying the sheet of paper 12 is supported by and engages at least the two rollers 27 and 28, and extends between the rollers 27 and 28. The guide member 31 is provided on the bottom-layer side of the conveyor belt 21 in a position corresponding to the printing region where the recording head 4 performs recording. The upper surface 31*a* of the guide member 31 projects toward the recording head 4 side beyond the tangent 32 of the two rollers 27 and 28 supporting the conveyor belt 21. This can prevent the chord part of the conveyor belt 21 corresponding to the printing region from including waviness or a variation in movement. As a result, it is possible to record an image with high quality.

Further, the separation mechanism (separation claw 41) separating the sheet of paper 12 from the conveyor belt 21 is provided on the paper ejection side of the conveyor belt 21. Accordingly, it is ensured that the sheet of paper 12 is separated from the conveyor belt 21 and ejected, thus preventing the occurrence of a paper jam.

Further, the conveyor belt 21 is formed of a double-layer structure including the top layer 21*a*, which is an insulating layer, and the bottom layer 21*b*, which is a medium resistance layer. Accordingly, a sufficient electrostatic adhesive force can be obtained so that the sheet of paper 12 can be conveyed stably and thus image quality can be improved.

In the above-described embodiments, the separation claw 41 is employed as a separation mechanism. Alternatively, an air separation mechanism that separates paper from the conveyor belt 21 by air blowing is also employable. Further, in the above-described embodiments, the ink-jet recording apparatus is a serial-type (shuttle-type) ink-jet recording apparatus where a carriage performs scanning. The present invention, however, is also applicable to a line-type ink-jet recording apparatus having a line-type head.

In addition to an ink-jet printer, the image-forming apparatus according to the present invention is also applicable to a facsimile machine, a copier, and a multi-function apparatus including the functions of a printer, a facsimile machine, and a copier. Further, the image-forming apparatus according to the present invention is also applicable to an image-forming apparatus that ejects liquid other than ink, such as a resist or a DNA sample in the medical field. Further, in terms of a recording method, the image-forming apparatus according to the present invention is applicable to not only an ink-jet recording apparatus but also an electrophotographic recording apparatus.

The present invention is not limited to the specifically disclosed embodiments, and variations and modifications may be made without departing from the scope of the present invention.

The present application is based on Japanese priority applications No. 2002-341834, filed on Nov. 26, 2002, No. 2002-341944, filed on Nov. 26, 2002, No. 2002-342036, filed on Nov. 26, 2002, and No. 2003-023221, filed on Jan. 31, 2003, the entire contents of which are hereby incorporated by reference.

The invention claimed is:

1. An image-forming apparatus, comprising:

an endless conveyor belt rotatable to convey paper with a surface of the conveyor belt being charged;

a counter roller for holding the paper between the conveyor belt and the counter roller and conveying the paper; and a clutch part that is caused to slip by a difference in velocity between the conveyor belt and the counter roller, wherein a linear velocity of the counter roller is set to be lower than a linear velocity of the conveyor belt, the paper is conveyed at a velocity of the conveyor belt and the counter roller is caused to slip by the difference in velocity between the conveyor belt and the counter roller, when the paper does not slip relative to the conveyor belt, and said counter roller is caused to operate together with said clutch part so that the paper is conveyed at a velocity of the counter roller, when the paper slips relative to the conveyor belt.

2. The image-forming apparatus of claim 1, further comprising:

at least two rollers supporting the conveyor belt, said at least two rollers including a conveying roller;

a driving part configured to provide a rotational driving force to the conveying roller to rotate the conveyor belt; and a transmission mechanism configured to transmit at least a portion of the rotational driving force to the counter roller, wherein the transmission mechanism includes the clutch part, and the clutch part is configured not to transmit the rotational driving force to the counter roller when the conveying roller is rotated in a direction opposite to a forward conveying direction.

3. The image-forming apparatus of claim 1, further comprising:

a charging part configured to charge the surface of the conveyor belt, wherein the paper adheres electrostatically to the conveyor belt as the conveyor belt conveys the paper, and wherein the conveyor belt has a multi-layer structure mid includes an outer insulating layer, and the charging part is disposed so as to come into contact with the outer insulating layer of the conveyor belt.

4. The image-forming apparatus of claim 1, wherein said conveyor belt comprises a double-layer structure comprising an outer insulating layer and an inner medium resistance layer, and wherein the outer insulating layer of said conveyor belt has a surface resistivity of 1E+10 Ω/sq or more and the inner medium resistance layer of said conveyor belt has a surface resistivity of 1E+08 Ω/sq or less.

5. The image-forming apparatus of claim 1, further comprising:

at least two rollers supporting the conveyor belt, wherein the conveyor belt engages the two rollers so as to extend therebetween, wherein the conveyor belt has a multi-layer structure and includes a medium resistance layer, and wherein one of the rollers engaging the conveyor belt is a ground roller and is in contact with the medium resistance layer of the conveyor belt.

6. The image-forming apparatus of claim 1, further comprising:

an image forming part configured to record an image on the paper; and a paper ejection part configured to eject the paper bearing the image from the conveyor belt, wherein the paper ejection part includes a separation mechanism that separates the paper from the conveyor belt on a side of the conveyor belt on which side the paper on which the image is recorded is ejected from the image-forming apparatus.

7. The image-forming apparatus of claim 1, wherein when to paper conveyed by the conveyor belt travels at a velocity different from the linear velocity of the conveyor belt, the paper slips relative to the conveyor belt, and said clutch part is configured to operate when the paper slips relative to the conveyor belt.

8. The image-running apparatus of claim 4, wherein the outer insulating layer of the conveyor belt is less than or equal to 60 μm in thickness and the inner medium resistance layer of the conveyor belt is greater than or equal to 40 μm in thickness.

9. The image-forming apparatus of claim 5, wherein the one of the rollers that is a ground roller has a volume resistivity of 1E+10 Ω/cm or less.

10. The image-forming apparatus of claim 6, wherein said separation mechanism is configured to be contactable with and separable from said surface of said conveyor belt.

* * * * *